US006672758B2

(12) United States Patent
Ehrsam et al.

(10) Patent No.: US 6,672,758 B2
(45) Date of Patent: Jan. 6, 2004

(54) ELECTRIC DEVICE FOR SWITCHING BETWEEN AT LEAST THREE DIFFERENT CONTACTS

(75) Inventors: Nicolas Ehrsam, Evilard (CH); Clement Meyrat, Le Landeron (CH)

(73) Assignee: The Swatch Group Management Services AG, Biel (CH)

( * ) Notice: Subject to any disclaimer, the term of this patent is extended or adjusted under 35 U.S.C. 154(b) by 165 days.

(21) Appl. No.: 09/883,297

(22) Filed: Jun. 19, 2001

(65) Prior Publication Data

US 2001/0053109 A1 Dec. 20, 2001

(30) Foreign Application Priority Data

Jun. 20, 2000 (CH) ..... 1211/00

(51) Int. Cl.[7] ..... G04B 27/02
(52) U.S. Cl. ..... 368/190; 368/216; 368/319
(58) Field of Search ..... 368/190, 69, 185–187, 368/216, 319–322, 284; 200/206 A

(56) References Cited

U.S. PATENT DOCUMENTS 4,395,134 A 7/1983 Luce
5,088,070 A 2/1992 Shiff
5,227,594 A * 7/1993 Russo ..... 200/6 A
5,378,862 A 1/1995 Tasaka et al.
5,621,196 A * 4/1997 Nishijima et al. ..... 200/6 A
6,160,225 A * 12/2000 Isikawa ..... 200/6 A
6,162,999 A * 12/2000 Ishikawa et al. ..... 200/6 A
6,246,019 B1 * 6/2001 Nakamura et al. ..... 200/6 A
6,334,706 B1 * 1/2002 Meyrat et al. ..... 368/321
6,344,619 B1 * 2/2002 Yamasaki et al. ..... 200/6 A
6,423,911 B2 * 7/2002 Yoshida et al. ..... 200/6 A

FOREIGN PATENT DOCUMENTS

EP 0 919 959 A1 6/1999

* cited by examiner

*Primary Examiner*—David Martin
*Assistant Examiner*—Jeanne M. Goodwin
(74) *Attorney, Agent, or Firm*—Griffin & Szipl

(57) ABSTRACT

The wall of a case includes a U-shaped recess with two through passages (11, 17) for a control stem (20) held in a neutral position by a spring (27) and guided in the outer passage (11) by an O ring (25) allowing translation and tilting movements, and in the inner passage (17) by a contour of oblong shape allowing the end (22) to close an electric contact (32) by pressure and two other contacts (31, 33) by tilting. Application to an electronic timepiece.

7 Claims, 2 Drawing Sheets

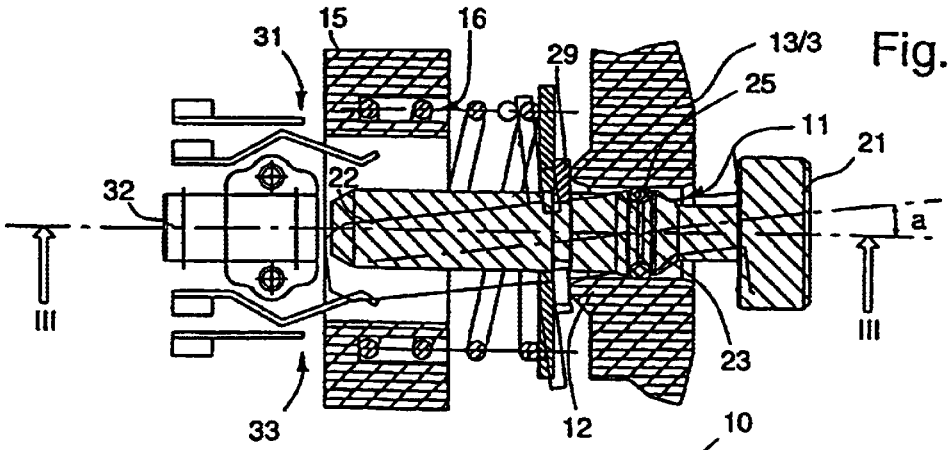
Fig. 2
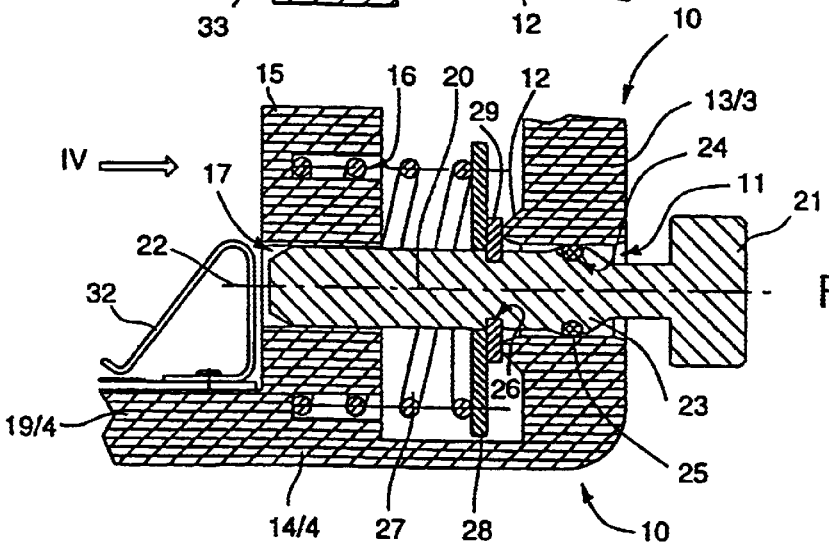
Fig. 3
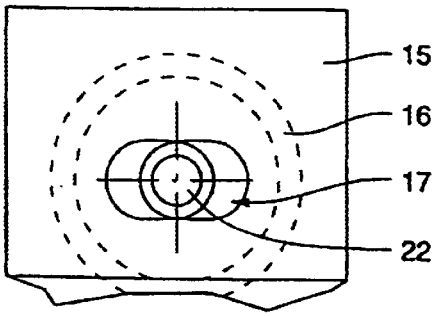
Fig. 4
Fig. 4A
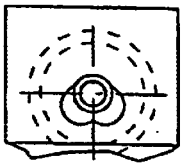
Fig. 4B
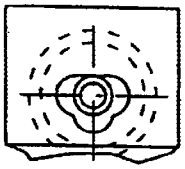
Fig. 4C
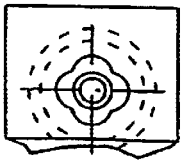

ELECTRIC DEVICE FOR SWITCHING BETWEEN AT LEAST THREE DIFFERENT CONTACTS

BACKGROUND OF THE INVENTION

The present invention concerns a switching device for an electric or electronic apparatus, which is of simple and economic design, and is able to close at least three different contacts of a circuit allowing said apparatus to perform three different functions. The invention concerns more particularly a device of this type for controlling, by means of a single control member, different functions of an electronic timepiece, such as setting the time, setting the date, or adjusting the alarm time of a watch, or the start, stop and reset functions of a chronograph watch, or for activating functions which are not necessarily linked to the passing of time, for example the lighting of the dial or the dive depth indication.

DESCRIPTION OF PRIOR ART

Timepieces provided with several functions generally include several buttons and/or push-buttons, which, via the order and way in which they are handled (short/long application of pressure, slow/quick rotation, etc.), allow instructions to be supplied to an integrated electronic circuit to control a determined function. It is evident that the user must also make an effort to remember the manipulations he has to perform to obtain the desired function. Further, even if certain users are apprised of the technical achievement of a product by its visual appearance, other users may prefer a product with a more discreet aesthetic appearance, i.e. including fewer buttons and/or push-buttons, while providing the same functionality as regards the functions.

SUMMARY OF THE INVENTION

The object of the present invention is precisely to provide an electric switching device allowing the number of external control members to be considerably reduced for the same number of functions.

The invention therefore concerns an electric switching device mounted in a case and including a frame having a U-shaped recess each branch of which includes, along an axis parallel to the base of the recess, a through passage for the passage of a control stem which can be actuated by means of a head located outside the case allowing the other end of the stem, located inside the case, to act on at least three electric contacts mounted on a plate extending beyond the frame. The opening of the first through passage, on the side of the head, is circular and has a larger diameter than that of the stem. The stem is guided inside this first passage by an O-ring housed in a groove of a swelling of the stem and abutting against the wall of said through passage. The other end of the stem is guided by the second through passage, on the side of the contacts, the opening of which has an elongated contour of substantially the same width as the diameter of the stem. The stem is held in these two through passages in a neutral position, i.e. without any action on the electric contacts, by means of a helical spring, held on one side in an annular groove surrounding the elongated contour, and compressed on the other side by a washer abutting against a clip engaged in a groove of the stem, said clip itself abutting against the selling of the first through passage. Thus, by exerting pressure on the head of the stem, it is possible to close a first electric contact located along its axis, and by imposing a tilting movement on the head, it is possible to close two other contacts close to the ends of the guide contour. As can be seen, this simple and economical design, allows at least three different switching positions to be obtained with a single control member, as may be necessary for example for the start, stop and reset functions of a chronograph watch.

Other features and advantages of the present invention will appear upon reading the following description of a chronograph watch taken by way of non limiting example with reference to the annexed drawings, in which:

BRIEF DESCRIPTION OF THE DRAWINGS

FIG. 2 is an enlarged top view of the switching device;

FIG. 3 is a cross-section of the switching device along the line III—III of FIG. 2;

FIG. 4 is a side view along the arrow IV of FIG. 3 of a part of the guide device; and FIGS. 4A, 4B and 4C are variants of the guide device shown in FIG. 4.

DESCRIPTION OF THE PREFERRED EMBODIMENTS

Figure 1:
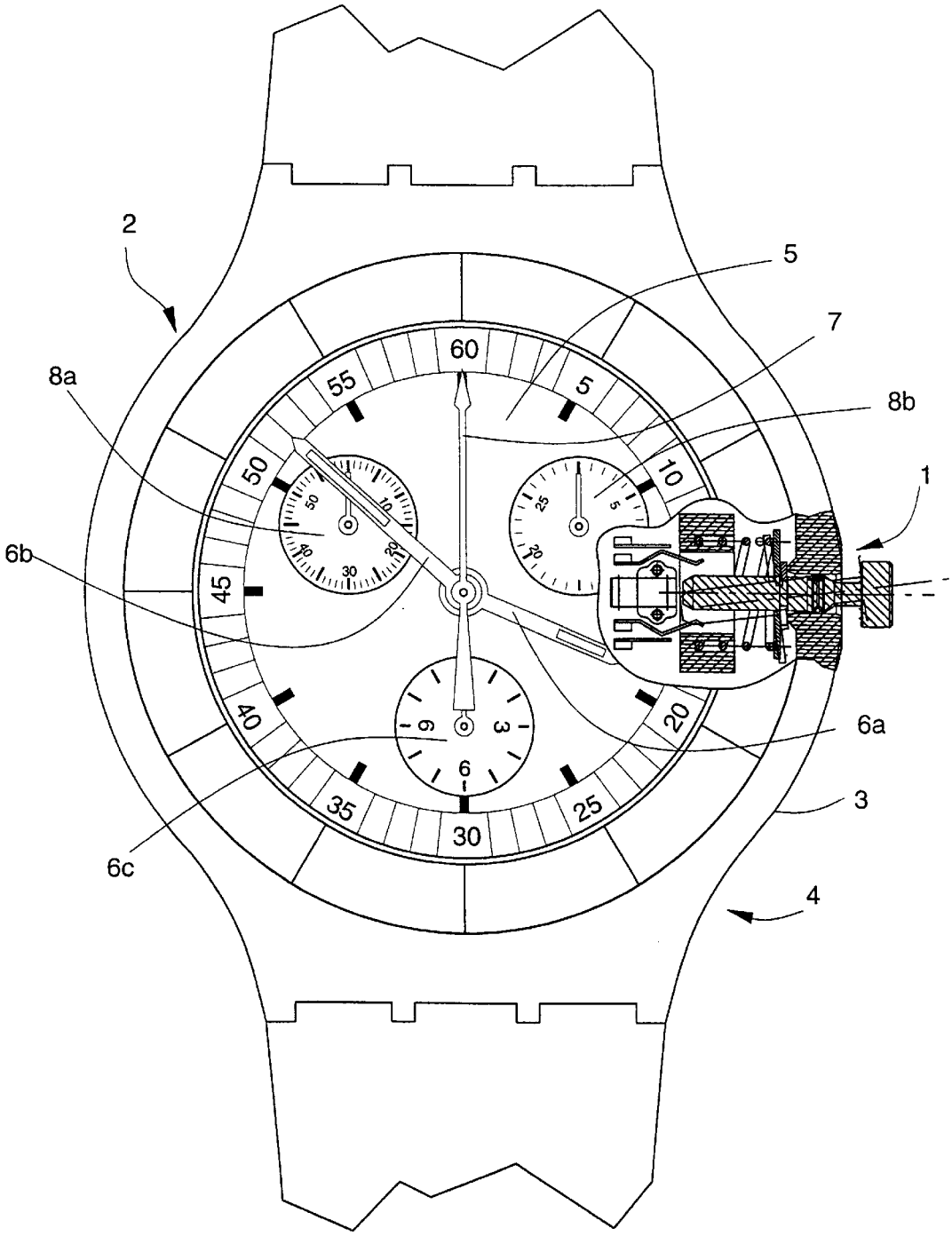
FIG. 1 is a top view, partially cut away of the switching device arranged at three o'clock.

FIG. 1 shows a chronograph watch including a case 2 closed by a middle part 3 and a back cover 4, and including a dial 5 for the display of the current time by means of hour hand 6*a*, minute hand 6*b* and a small second hand 6*c* and for the display of a measured interval of time, by means of a centre second hand 7 and two counters for the hours 8*a* and for the minutes 8*b*. These hands and counters are driven in a known manner by an electronic chronograph movement, powered by a power source, which is not shown. Within the framework of the example chosen for the present invention, the instructions addressed to the electronic movement are given only by electronic switching device 1, which is explained in more detail hereinafter with reference to FIGS. 2 and 3.

With reference first of all to FIG. 3, it can be seen that the mechanism essentially includes a rigid structure formed on a frame 10 through which a stem 20 passes, held by resilient means including a helical spring 27, in a neutral position wherein none of contacts 31, 32, 33 are activated, said contacts being supported by a plate 19 extending beyond frame 10. The frame includes a base 14 and two vertical extensions forming an outer branch 13 and an inner branch 15 of a U-shaped recess, through which passes stem 20, including a setting head 21, and an end 22 in proximity to contacts 31, 32, 33. In the example shown, this U-shaped recess is integral with case 2, base 14 and plate 19 being integral with back cover 4, and outer branch 13 being integral with middle part 3.

Each of vertical extensions 13, 15 includes a through passage 11, 17 for stem 20. Through passage 11, on the side of head 21, has a circular opening with a larger diameter than that of stem 20. Stem 20 is guided in passage 11 by the sliding friction of an O-ring 25 held in place axially in groove 24 by a swelling 23 of stem 20. Swelling 23 and O-ring 25 form, in a way, a bulging out portion of stem 20 allowing it to tilt in all directions. Likewise, in order to have sufficient play between stem 20 and the inner wall of passage 11 permitting a tilt of an angle $\alpha$, it is possible to provide an O-ring 25 with a large diameter which no longer needs to be radially offset by means of a swelling. Stem 20 can thus be manoeuvred in passage 11 both in translation and by exerting axial pressure on head 21, and by tilting at an angle α by exerting lateral pressure. The value of angle of swing α depends of course on the length of passage 11 and the relative diameters of the opening of passage 11 and stem 20. In the application to a timepiece of small dimensions a suitable value of angle α is approximately 7°.

Through passage 17, on the side of electric contacts 31, 32, 33, has an oblong shape, which is more visible in FIG. 4, which has the width of the diameter of stem 20 and it allows ends 22 thereof to be guided in the tilting movement to abut against one or other of the two contacts 31, 33 which, in the example shown, are flexible strip contacts. Through passage 17 may have a different guide contour to that which has just been described, for example with a V-shape median line (FIG. 4A), which may be advantageous from the point of view of handling in the case of a wristwatch. It is also possible to give this guide contour a T shape (FIG. 4B) allowing three contacts to be established, or in the shape of a Greek cross (FIG. 4C) allowing four contacts to be established.

To hold stem 20 in the neutral position, or to return it to this position after an application of pressure or a tilt, the device includes, in U-shaped recess of frame 10, resilient means formed by a helical spring 27 one end of which is housed in an annular groove 16 of branch 15 on the contact side surrounding the guide recess, and the other end of which abuts against a washer 28 threaded onto stem 20, before the spring is set in place. The outer surface of washer 28 is blocked by a clip 29 engaged in a groove 26 of stem 20. The pressure exerted by spring 27 holds clip 29 abutting against flange 12 of branch 13, so that, when no action is exerted on head 21, the stem has an axial position and its end 22 does not abut against any of the contacts.

The construction which has just been described may of course be associated with technologies allowing, by analysing the manipulations by the integrated circuit, to determine which function has to be executed, for example as a function of the length of time that the head of the pusher is held in a determined position. It is also possible, by a suitable arrangement of contacts 31, 32, 33, to have a "pressure-swing" manipulation which could be interpreted by the electronic circuit to execute other functions.

What is claimed is:

1. Electric switching device mounted in a case, the case including:

a frame having a U-shaped recess formed by two branches of the frame, wherein each branch includes, along an first axis parallel to a base of the recess, a through passage for a stem, wherein one end of the stem is provided with a setting head disposed outside of the case, and the other end of the stem is disposed, inside the case, wherein the end of the stem disposed inside the case is positioned to act on at least three electric contacts mounted on a plate extending beyond the base of the frame, wherein an opening of the through passage located in one of the branches, by the head; is circular, wherein an inner edge of the circular opening is provided with a flange, wherein a diameter of the flange is greater than a diameter of the stem that is guided inside of the through passage by an O-ring, wherein the O-ring is housed in a groove of an annular swelling of the stem, whereas the through passage in the other one of the branches, by the electric contacts, includes at least an elongated guide contour having a width substantially the same as a width of the diameter of the stem, wherein the contour is surrounded by a circular groove that accommodates a helical spring compressed at an end by a washer abutting against a clip, wherein the clip is engaged in a groove in the stem and a surface of the clip abutts against the flange of the through passage by the head so as to allow, by acting on the head a tilting movement of one end of the stem along the elongated contour to close an electric contact located in proximity to one end of the elongated contour, and on the other hand, to allow an axial displacement along the first axis to close another electric contact.

2. Electric switching device according to claim 1, wherein the guide contour has an oblong shape or is V-shaped with two electric contacts in proximity to distal parts of the guide contour.

3. Electric switching device according to claim 1, wherein the guide contour is T-shaped or has the shape of a Greek cross with three or four electric contacts in proximity to distal parts of said contour.

4. Electric switching device according to claim 1, wherein the electric contacts are flexible metal strip contacts.

5. Electric switching device according to claim 1, wherein the case is a timepiece case having a middle part and a back cover, said device allowing the time related functions or non time-related functions of said timepiece to be controlled.

6. Electric switching device according to claim 5, wherein the frame is integral with the middle part forming one branch of the U-shaped recess that is on the side of the head and with the back cover to form, perpendicular thereto, another branch of said frame.

7. Electronic timepiece, wherein the time and non time-related functions are controlled by a switching device according to claim 1.

* * * * *